United States Patent [19]

Taylor

[11] 3,945,304

[45] Mar. 23, 1976

[54] ACTUATORS

[75] Inventor: Roger Keith Taylor, North Wembley, England

[73] Assignee: Tourdelos Limited, England

[22] Filed: Aug. 5, 1974

[21] Appl. No.: 495,051

Related U.S. Application Data

[63] Continuation of Ser. No. 269,225, July 5, 1972, abandoned.

[30] Foreign Application Priority Data

July 5, 1971 United Kingdom ..... 31441/71

[52] U.S. Cl. ..... 92/140; 74/110; 74/520

[51] Int. Cl.[2] ..... F01B 9/00

[58] Field of Search ..... 74/520, 110; 92/140

[56] References Cited

UNITED STATES PATENTS 2,897,784 8/1959 Harper ..... 92/140

*Primary Examiner*—Paul E. Maslousky

*Attorney, Agent, or Firm*—Neil F. Markva

[57] ABSTRACT

An actuator has force amplifying means coupled between piston and piston rod. The force amplifying means may be a mechanical linkage, a system of screw threads, or a hydraulic arrangement utilizing differential piston areas and may lock the piston rod at one or both stroke extremities. The mechanical advantage of the force amplifying means may vary during the stroke.

11 Claims, 12 Drawing Figures

$1.\ AC = AB + \frac{AB}{3}$ $2.\ AC = AB + \frac{AB}{12}$ $3.\ AC = AB$

ACTUATORS

This is a continuation of application Ser. No. 269,225 filed July 5, 1972 now abandoned.

SUMMARY OF THE INVENTION

This invention relates to actuators.

According to the invention an actuator includes a cylinder, a piston slidable in the cylinder, a piston rod, and force amplifying means disposed within the cylinder and arranged to transmit force between the piston and the piston rod.

The force amplifying means may include a mechanical linkage such as a lazy tongs or a toggle mechanism. With a toggle mechanism the mechanical advantage may vary during the piston stroke, there may be a positive mechanical advantage during only a part of the piston stroke, and the mechanism may lock at one or both extremities of the piston stroke.

BRIEF DESCRIPTION OF DRAWINGS

By way of example only, several embodiments of the invention will now be described with reference to the accompanying drawings of which.

DESCRIPTION OF SPECIFIC EMBODIMENTS

Figure 1:
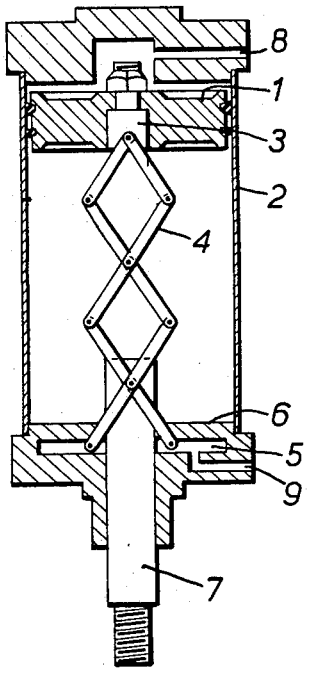
FIG. 1 is a sectional side elevation of a first actuator.

Referring to FIG. 1, the first actuator includes a piston 1 in a cylinder 2, the piston having a lug 3 on its underside by which it is connected to one end of a lazy tongs linkage 4. The lazy tongs 4 comprise two and a half rhombic sections, the free ends having pins which are received in sliding engagement in a groove 5 in an end-plate 6 of the cylinder. The piston rod 7 of the actuator passes through the end-plate 6 and is connected to the lazy tongs 4 at the lowermost pivot thereof. The cylinder 2 has working fluid ports 8 and 9 disposed beyond the extremes of travel of the piston 1.

Figure 2:
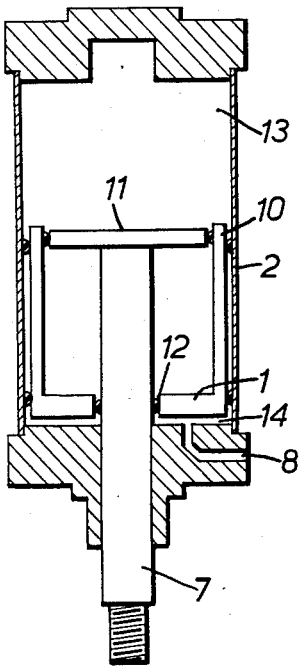
FIG. 2 is a sectional side elevation of a second actuator.

Referring to FIG. 2, the second actuator includes a single-acting piston 1 within the skirt 10 of which slides a subsidiary piston 11 mounted on a piston rod 7. The piston rod passes through a seal 12 in the crown of the piston 1. The space 13 between the end of the cylinder 2, the annular extremity of the skirt, and the crown of the piston 1 contains hydraulic fluid, the space 14 between the other end of the cylinder 12 and the crown of piston 1 having a working fluid port 8. Because of the difference in surface area between the crown of the piston 11 and the annular extremity of the skirt 10 a force applied to the crown of piston 1 results in a greatly increased force on the crown of piston 11, the force applied to the piston rod 7 thus being amplified. To enable air to escape from the space between the pistons on air duct (not shown) passes axially through the piston rod 7 of the outside of the cylinder. A compression spring (also not shown) is disposed axially between the two pistons to separate them when working pressure is removed from port 8.

Figure 3:
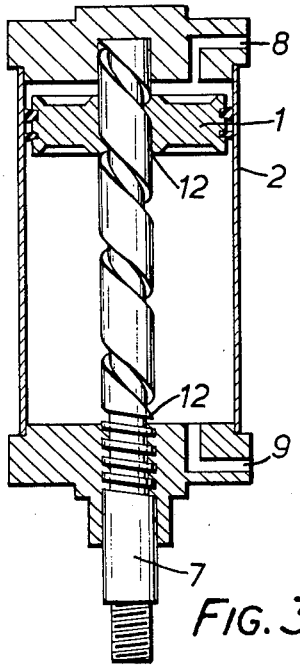
FIG. 3 is a sectional side elevation of a third actuator.

Referring to FIG. 3, the third actuator includes a piston 1 constrained to slide on a coarse-pitch buttress thread on the piston rod 7 without rotating relative to the cylinder 2. The piston rod 7 engages the lower end-plate of the cylinder 2 via a thread of comparatively fine pitch. There are seals 12 between the piston rod 7 the piston and between the rod 7 and the lower end-plate. The cylinder 2 has working fluid ports 8 and 9 disposed beyond the extremes of travel of the piston 1. Rotation of the piston rod 7 caused by the descending piston 1 will screw the piston rod 7 outwards through the end-plate. The difference between the pitches of the two threads means that a force applied to the piston is amplified during transmission to the piston rod. The pitch of the end-plate thread is usually selected such that movement of the piston rod can only be effected by the application of pressure to the piston.

The fourth actuator, shown in FIGS. 4A to 4D, employs a toggle mechanism arranged to vary the force amplification throughout the stroke such that near the end of the working stroke when the piston nears the bottom of the cylinder the force amplification is large whereas during the first part of the working stroke the force amplification is small or even negative. Such an actuator has application to, for example, a punch in which the upper part of the stroke is required only for the purpose of giving clearance to enable workpieces to be inserted in and removed from the dies.

Figure 4A:
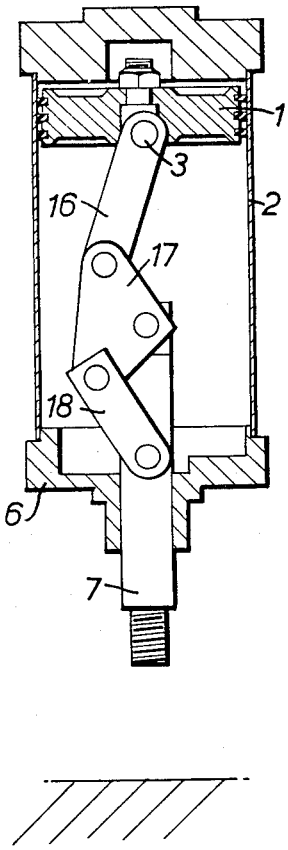
FIGS. 4A, 4B and 4C are sectional side elevations of a fourth actuator and show the piston at the top, middle and bottom of its stroke.
Figure 4B:
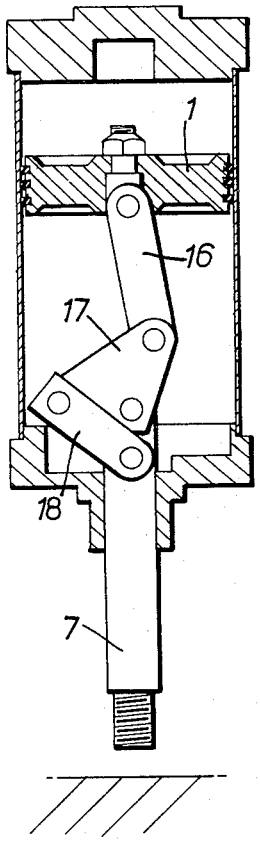
Figure 4C:
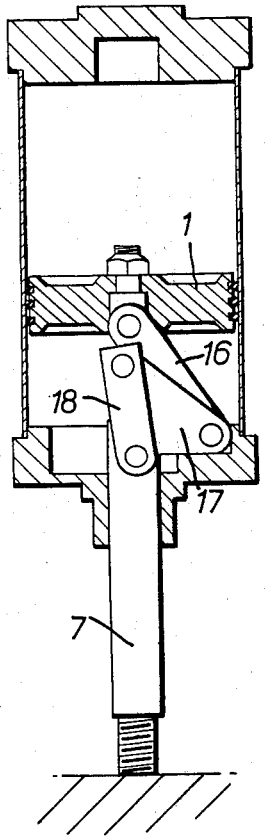
Figure 4D:
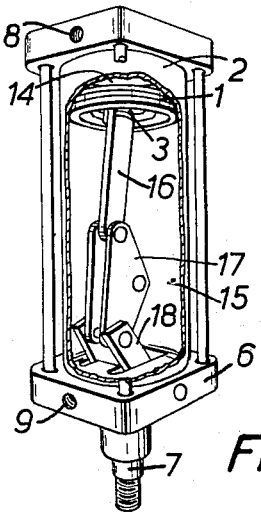
FIG. 4D is a cut-away perspective view of the fourth actuator.

Referring now to FIGS. 4A and 4D, a piston 1 is slidable within a cylinder 2, the lower end-plate 6 of the cylinder slidably supporting a piston rod 7. Pivotally connected to the upper end of the piston rod 7 are a pair of triangular plates 17, the triangular plate being in turn connected to the piston 1 via a connecting rod 16 and to the lower end-plate 6 by a pair of swing links 18.

Figure 4E:
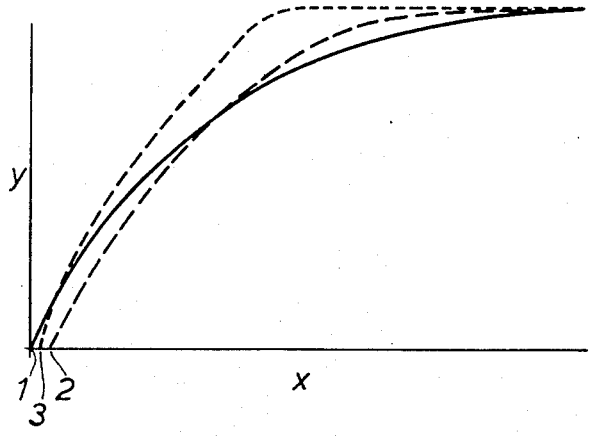
FIG. 4E is a similar view to FIG. 4A but is drawn to a larger scale and shows the loci followed by actuator components during movement of the piston.
Figure 4E:
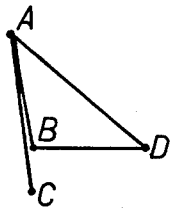
Figure 4F:
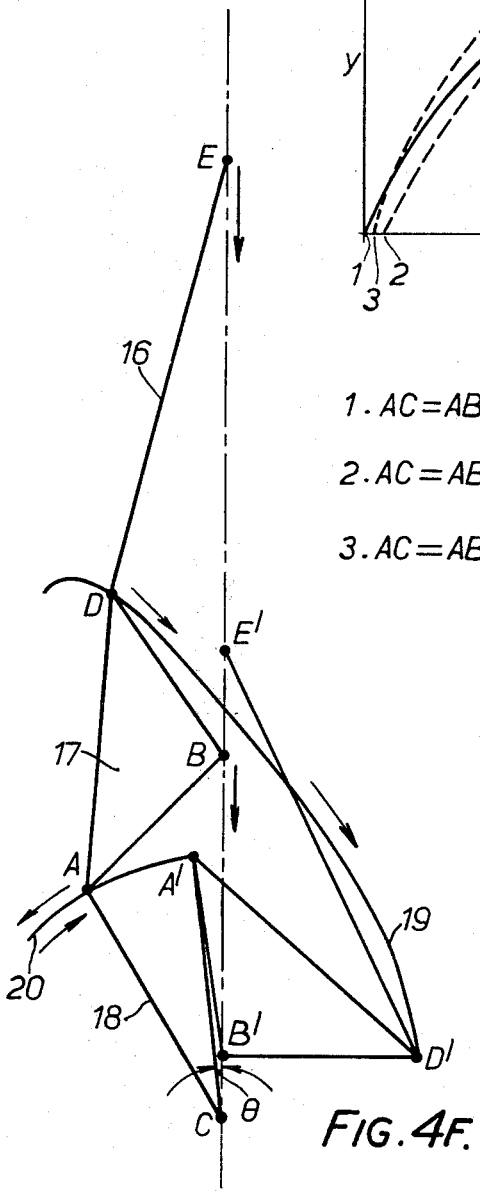
FIG. 4F is a plot of piston displacement $x$ against piston rod displacement $y$ to linear scales.

Referring to FIGS. 4E and 4F, the connecting link 16 is coupled to the piston 1 by pivot E and to the triangular plates 17 by pivot D. The triangular plates 17 are coupled to the piston rod 7 by pivot B and to the swing links 18 by pivot A. The swing links 18 are anchored to the end-plate 6 by pivot C. As the piston 1 descends pivot E moves to position E′, and the triangular plates 17 rotate clock-wise such that pivot D follows to position D′ the locus 19 shown in FIG. 4E. Pivot A moves first to the left and then to the right along locus 20 to position A′ and pivot B, the upper end of the piston rod 7, moves down to B′.

It will be noticed that position A′ represents a condition in which the swing links 18 are very near to moving across the axis of the piston rod 7. Were they to do so the piston rod would of course be locked by an over-center action. It has in fact been found with the actuator described with reference to FIGS. 4A to 4D that provided angle $\theta$ is less than approximately 10°, friction will lock the piston rod notwithstanding that an over-center action does not quite take place.

It should also be noted that the upper end of the locus 19 has a distinct downward turn only a little to the left of point D. In order that the mechanism shall not be inadvertantly locked by the pivot D moving further to the left than is shown in FIG. 4E it is necessary to provide a piston stop to limit travel of the piston; usually the piston stop will be a surface of the upper end-plate of the cylinder 2.

Referring particularly to FIG. 4F the plot of piston displacement $x$ against piston rod displacement $y$ has been performed for three lengths of swing link 18. The origin of the graph represents the top of the stroke, and it will be seen that all three curves show that during the first part of a downward piston stroke the piston rod moves more quickly than the piston but that toward the end of the stroke the piston rod moves very much more slowly than the piston and that a large amplification of force is obtained. This will also be apparent from the relative piston and piston rod positions shown in FIGS. 4A and 4C. It will be appreciated that the ratio AC:AB can be varied to suite particular applications for the actuator. Curve number 3 represents a special case in which the second half of the piston stroke provides no piston rod movement.

Figure 5A:
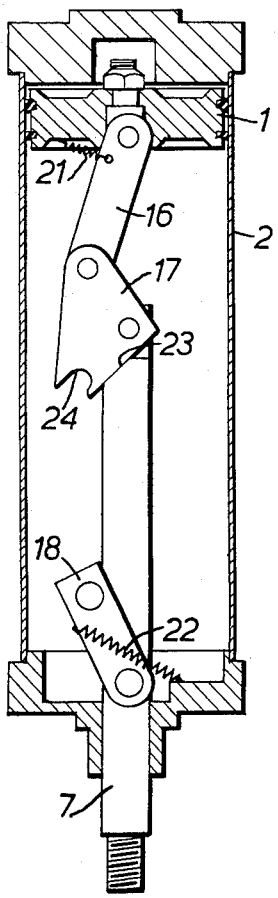
FIGS. 5A and 5B are sectional side elevations of a fifth actuator.
Figure 5B:
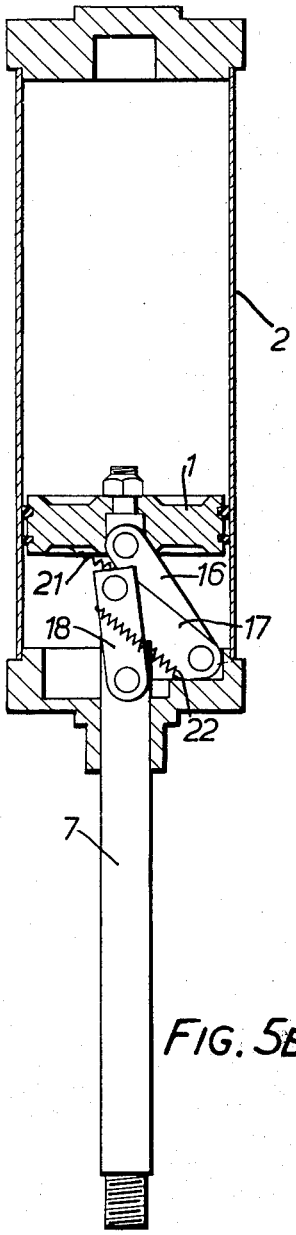

Referring to FIGS. 5A and 5B, there is shown a fifth actuator which is a modification of the fourth. The swing links 18 are freed from the triangular plates 17 such that during most of the piston stroke there is no force amplification, the triangular plates 17 resting on shoulders 23 machined on the piston rod 7. A tension spring 21 is provided to ensure correct parking of the connecting rods 16 and the triangular plates 17. Only toward the bottom of the piston stroke do cut-outs 24 in the triangular plates 17 engage a pin carried by the upper ends of the swing links 18; after this contact is established the remainder of the downward stroke is identical to that described with reference to FIGS. 4E and 4F. When the piston is retracted the toggle mechanism reverses until the cut-outs 24 disengage, a spring 22 then serving to maintain the pin through the swing links 18 in contact with the piston rod 7 ready for subsequent re-engagement during the next downward piston stroke.

In practice, piston stability may be improved either by providing a piston skirt or by coupling two pistons together.

Another modification (not illustrated) of the actuator described with reference to FIGS. 4A and 4D has elongate slots in the triangular plates 17 in place of the cut-outs 24 shown in FIG. 5A.

Figure 6:
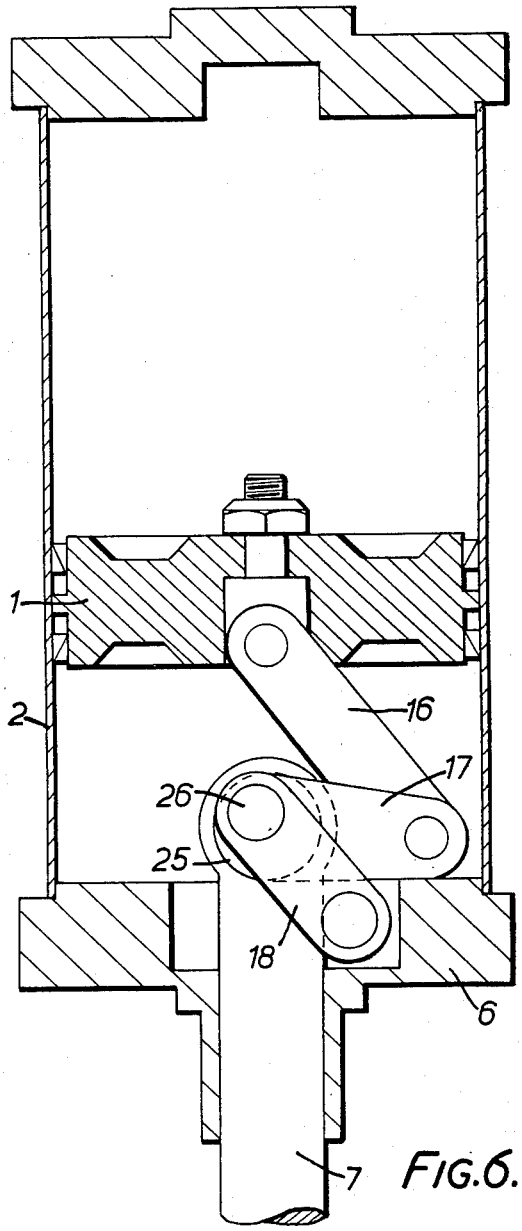
FIG. 6 is a sectional side elevaton of a sixth actuator Like parts have the same reference numerals throughout the drawings.

Referring finally to FIG. 6, the sixth actuator is in effect a further modification of the fourth and is intended particularly for heavier loadings. The inner end of the piston rod 7 is enlarged to accommodate a large diameter bearing pin 25. Carried eccentrically by a pin 25 is a smaller pin 26 which serves as a pivot for the upper ends of swing links 18. The larger pin 25 is rigidly connected to a pair of intermediate links 17, which in turn are pivotally coupled to a connecting link 16. Because of the very small offset of the center of pin 26 from the center of pin 25 this embodiment provides an especially large force amplification. The swing links 18 are anchored to the lower end-plate 6 of the cylinder 2 at a point offset relative to the piston rod 7, the arrangement permitting a single, continuous pin to be used at this point.

While all six actuators herein described are primarily intended for pneumatic use, it will be appreciated that the invention also has application to hydraulic actuators, particularly those intended for use at comparatively low hydraulic pressures.

I claim:

1. An actuator which comprises:

a. a cylinder, b. a piston slidably mounted in the cylinder, c. a piston rod slidably mounted in the cylinder, and d. a mechanical linkage arranged within the cylinder, e. the mechanical linkage including a rigid link on which, during at least part of the piston stroke, a first point is coupled to the piston, a second point is coupled to the piston rod and a third point is coupled to a wall of the cylinder, f. the distance of the first point from the third point being greater than the distance of the third point from a line through the second point parallel to the direction of movement of the piston rod and during at least part of the stroke the first point and the third point are on opposite sides of the said line so that the mechanical advantage of the link is transmitting force from the piston to the piston rod is greater than one.

2. An actuator which comprises:

a. a cylinder, b. a piston slidably mounted in the cylinder, c. a piston rod having an axis slidably mounted in the cylinder and a mechanical linkage arranged within the cylinder, d. the mechanical linkage including a rigid link on which, during at least part of the piston stroke, a first point is coupled to the piston, a second point is coupled to the piston rod and a third point is coupled to a further link which is pivotally connected to a wall of the cylinder about a fixed axis, e. the distance of the first point from the third point being greater than the distance of the third point from the second point and during at least part of the stroke the first point and the third point being on opposite sides of the axis of the piston rod so that the mechanical advantage of the linkage is transmitting force from the piston to the piston rod is greater than one.

3. An actuator as claimed in claim 11, wherein the said fixed axis of the pivoted connection intersects the axis of the piston rod and the length of the further link is in the range from one to one and one-third times the distance of the second point to the third point.

4. An actuator as claimed in claim 3, wherein the coupling between the third point on the rigid link and the further link is disengageable so that the rigid link engages the further link when the piston is in a position between its top-dead-center and bottom dead center positions.

5. An actuator comprising:

a. a cylinder, b. a piston slidably mounted in the cylinder, c. a piston rod having an axis and being slidably mounted in the cylinder, and d. a mechanical linkage arranged within the cylinder and interconnecting said piston and piston rod, e. said linkage comprising a rigid member, a first link pivoted at one end to said member at a first pivot point and at its other end to said piston, said rigid member being pivoted to said piston rod at a second pivot point, a second link pivoted at one end to said cylinder and being, at its other end, pivotally engageable with said member at a third pivot point in at least some relative axial positions of the piston and piston rod, f. said pivot connection between said second link and said cylinder being at all times further from the piston than the third pivot point, and g. said first pivot point being at all times on the same side as the piston rod axis of a line through the third pivot point parallel to the axis of the piston rod.

6. An actuator as claimed in claim 5 and having a permanent pivotal connection between said second link and said member at said third pivot point.

7. An actuator as claimed in claim 5 and comprising a recess in said member at said third pivot point said other end of said second link being pivotable in said recess.

8. An acutator as claimed in claim 5 wherein said member comprises a bearing, a pin and an arm, said bearing being rotatably mounted in the end of the piston rod with the axis of the bearing being the second pivot point, said pin eccentrically mounted on the bearing, the second link being pivoted on the pin and the pin comprising the third pivot point, and said arm extending from the bearing on the opposite side of the axis of the piston rod from the pin, the arm carrying the first pivot point.

9. An actuator as claimed in claim 5 wherein the axis of the pivotal connection of the second link to the cylinder intersects the axis of the piston rod.

10. An actuator as claimed in claim 5 wherein the pivotal connection of the second link to the cylinder is on the opposite side of the axis of the piston rod from the third pivot point.

11. An actuator as claimed in claim 2 wherein said fixed axis is located at a position radially spaced from the axis of the piston rod.

* * * * *